US005127127A

United States Patent [19]

Jarosinski

[11] Patent Number: 5,127,127

[45] Date of Patent: Jul. 7, 1992

[54] HAND-HELD WIPING DEVICE

[76] Inventor: Louis Jarosinski, N3929 Conrad St., Freedom, Wis. 54130

[21] Appl. No.: 678,019

[22] Filed: Apr. 1, 1991

[51] Int. Cl.[5] ..... A47L 25/00

[52] U.S. Cl. ..... 15/227; 15/104.94; 2/159

[58] Field of Search ..... 15/227, 104.94; 2/158, 2/159

[56] References Cited

U.S. PATENT DOCUMENTS 1,731,340 10/1929 Lambert ..... 15/227
3,902,509 9/1975 Tundermann et al. ..... 15/227

FOREIGN PATENT DOCUMENTS 752591 2/1967 Canada ..... 15/227
1482990 4/1967 France ..... 15/227

*Primary Examiner*—Edward L. Roberts
*Attorney, Agent, or Firm*—Andrus, Sceales, Starke & Sawall

[57] ABSTRACT

A hand-held paper wipe made of a unitary sheet of absorbent paper is formed of two overlying layers integrally joined by a common fold line. One layer forms a primary wiping layer having a generally flat rectangular surface large enough to cover at least the fingers of the hand. The other overlying layer has a somewhat greater lateral width than the primary wiping layer such that it may be gathered laterally and bound to the underlying main wiping layer by a series of spaced seams extending generally perpendicular to the fold line to form finger-receiving pockets. In use, the wipe is held in place by squeezing the fingers together and is readily disposed of after use by opening the fingers and allowing the wipe to fall off by gravity.

13 Claims, 2 Drawing Sheets

HAND-HELD WIPING DEVICE

BACKGROUND OF THE INVENTION

The present invention pertains to a unitary hand-held paper wipe and, more particularly, to an auxiliary paper wipe formed in the shape of a glove or mitt.

A myriad of paper products are available today for use in a wide variety of cleaning, polishing and wiping tasks. These include paper napkins, towels, facial tissues, toilet tissue, and a large number of other kinds of single and multi-layer moisture-absorbent paper products. Although many of these products are folded or rolled for storage and/or dispensing, all are ultimately used in an unfolded generally flat orientation. In this orientation, many paper products tend to wrinkle, bunch up, and/or tear and are difficult to retain in a flat orientation. Conventional toilet tissue or toilet paper is a good example of a paper product exhibiting the foregoing problems and one which has essentially remained unchanged for many years. Paper towels and similar wiping materials also are subject to the same problems encountered in attempting to hold them flat against a surface which is being wiped.

It would be desirable, therefore, to have a paper wiping product in which the active wiping surface would remain generally flat during use, would not easily bunch or tear, and one which would also provide a protective cover for the hand of the user.

SUMMARY OF THE INVENTION

In accordance with the present invention, there is provided a one piece moisture-absorbent paper wipe which may be used to provide an effective substitute for toilet paper, paper towels, and other similar products, and which is made generally in the shape of a partial or full hand-covering glove or mitt. In this way it may be easily retained in place while being used, provide hand-protective covering, and be easily disposed of after use by simply allowing the same to drop by gravity from the hand.

A unitary hand-held paper wipe made in accordance with the present invention includes a sheet of absorbent paper which defines a generally flat rectangular wiping layer having a surface large enough to fully cover the fingers of an average size hand. The sheet also includes an extended length portion which is folded on a main fold line to form an overlying layer that covers the primary wiping layer. The overlying layer is attached to the primary layer with sealing means forming spaced seams which extend generally perpendicular to the main fold line and define finger-receiving pockets.

The extended length portion of the sheet has a width in the direction of the main fold line which is greater than the corresponding width of the primary wiping layer to allow the overlying layer to be gathered in the direction of the fold line to form the finger-receiving pockets without gathering or wrinkling the flat primary wiping layer. The seams may comprise five in number to define therebetween four finger-receiving pockets.

In a preferred embodiment, the opposite edges of the primary wiping layer are provided with integral lateral width extensions which are folded on auxiliary fold lines to form lateral layers which overlie a portion of the primary wiping layer adjacent each of the opposite edges. The spaced seams include two outer seams which bind three separate layers, including the primary layer, the overlying layer, and the lateral layer, to form outer finger-receiving pockets to accommodate the index and little fingers of the hand, and an inner seam lying between the two outer seams and defining therewith pockets for the two middle fingers.

The sealing means may comprise a water soluble adhesive, or a fiber-interlocking crimp formed directly in the bound overlying layers. Conventional stitching may also be used. The primary wiping layer may also comprise a multi-layer laminate.

In another embodiment, the edge of the primary wiping layer opposite the main fold line is provided with an integral longitudinal extension which defines a flat supplemental surface large enough to cover the palm and thumb of the hand. The longitudinal extension includes an integral side piece which is folded on an outer fold line to form a thumb covering layer from one part of the side piece, which part covers the remaining part of the side piece. The sealing means includes a side seam which binds the overlying parts of the side piece to form a thumb-receiving pocket.

DETAILED DESCRIPTION OF THE PREFERRED EMBODIMENTS

Figure 1:
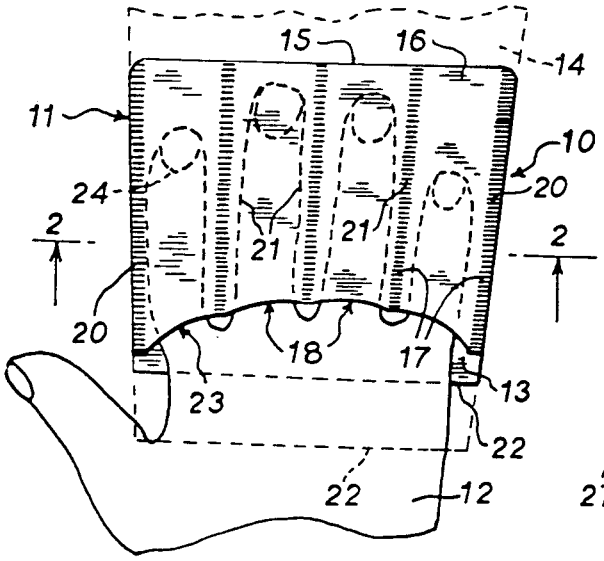
FIG. 1 is a top plan view of the hand-held paper wipe of the present invention in its most basic embodiment, shown held on the hand of the user.
Figure 2:
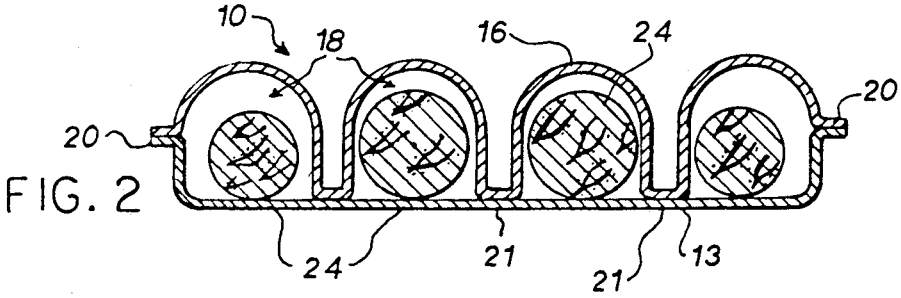
FIG. 2 is a sectional view taken on line 2—2 of FIG. 1.

Referring initially to FIGS. 1 and 2, the hand-held paper wipe 10 of the present invention is shown in its most basic embodiment. It is constructed from a unitary sheet 11 of absorbent paper and folded and sealed to fit over the fingers of a hand 12 in the manner of a glove or mitt. The sheet 11 includes a primary wiping layer 13 which is generally rectangular in shape and defines a flat surface large enough to cover the fingers of a hand of average size. The sheet also includes an extended length portion 14 which is folded on a main fold line 15 to form an overlying layer 16 which substantially covers the primary wiping layer 13. The primary layer 13 and the overlying layer 16 are then bound with spaced seams 17 which extend generally perpendicular to the main fold line 15 and define between the seams a series of finger-receiving pockets 18.

The extended length portion 14 of the sheet 1, prior to folding, fans out from the main fold line 15 to provide an average width in the direction of the main fold line which is greater than the corresponding width of the primary wiping layer 13. When the extended length portion 14 is folded on the main fold line 15 to create the overlyinq layer 16, the greater width of the overlying layer allows it to be gathered laterally to create the pockets 18 which are fixed by the seams 17. Referring particularly to FIG. 2, the outer lateral edges of the primary wiping layer 13 and the extended length portion 14 are joined with outer seams 20 and the gathered center portion of the overlying layer 16 is bound to the primary wiping layer 13 with three interior seams 21, thereby defining four finger-receiving pockets 18. By gathering only the overlying layer 16, the primary wiping layer 13 remains substantially flat.

The seams 20 and 21 may be formed with any convenient means, including water soluble adhesive, stitching, or crimping to interlock the fibers of the two layers. The latter technique is particularly attractive because it completely eliminates the need for a separate adhesive material or other stitching medium. Crimping is well known in the art and, in accordance with one method, the seams are formed by running the overlying layers between a pair of meshing toothed gear rolls. Such crimped seams are specifically shown in FIGS. 1 and 7. If an adhesive is used, glue material may be conserved by using a line of spaced adhesive spots.

As is best seen in FIG. 1, the primary wiping layer 13 extends to an inner edge 22 that runs generally across the palm of the hand just inside the inner ends of the fingers. However, the layer may be extended somewhat to cover more of the palm, as shown in the phantom line extension. The corresponding inner edge 23 of the overlying layer 16 may lie coextensive with the inner edge 22, but may also be somewhat shorter, as shown, primarily to save paper material. The fingers 24 of the user are inserted into the respective pockets 18 and, by simply squeezing the fingers together, the wipe is held firmly in position for use. When the use is completed, the wipe may be easily and conveniently disposed of simply by pointing the fingers downwardly, spreading them slightly, and allowing the wipe to drop off for disposal.

One of the primary intended uses of the wipe 10, and the other embodiments to be described hereinafter, is as a substitute for conventional rolled toilet paper. For this purpose, the absorbent paper sheet 11 would be made of conventional crepe wadding having low wet strength to be compatible with conventional sewage systems. The smaller size of the FIG. 1 embodiment is also more desirable for use as toilet tissue because the paper load on the sewage system is minimized. For other uses, such as a substitute for conventional paper towels, the sheet 11 may be made of stronger paper material having greater wet strength.

Figure 3:
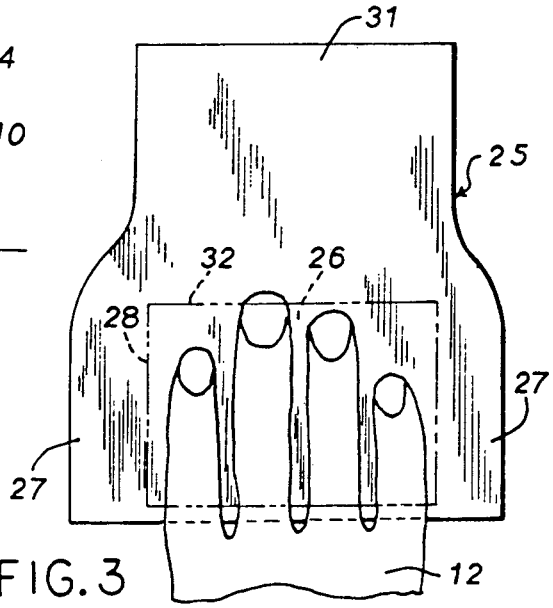
FIG. 3 is a top plan view of an improved version of the paper wipe of the present invention shown prior to folding and sealing to form the finger-receiving pockets.
Figure 4:
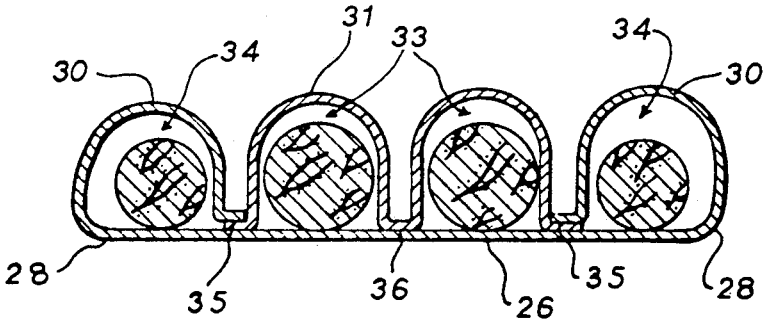
FIG. 4 is a sectional view similar to FIG. 3 showing the modified version of FIG. 2 after folding and sealing.

FIGS. 3 and 4 show an embodiment of the invention in which the outer seams 20 of the FIGS. 1 and 2 embodiment are eliminated to provide smooth lateral outer edges. In this embodiment, the sheet 25 includes a similar primary wiping layer 26, but the layer 26 is extended laterally by integral lateral width extensions 27 on opposite edges of the primary wiping layer. The lateral width extensions 27 are folded on auxiliary fold lines 28 to form lateral layers 30 which overlie portions of the primary wiping layer adjacent the fold lines 28. The extended length portion 31 (which may be somewhat narrower than the corresponding portion 14 of the previously described embodiment) is folded over the primary wiping layer 26 on a main fold line 32 and gathered to form inner pockets 33 for the two middle fingers of the hand. The lateral layers 30 are gathered and bound by their edges to the lateral edges of the extended length portion 31 and the underlying primary layer 26 to form outer pockets 34 for the index and little fingers of the hand. As is best shown in FIG. 4, this construction utilizes three spaced and generally parallel seams including two outer seams 35 binding three layers 26, 30 and 31, and a single inner seam 36 binding two layers 26 and 31.

The use of the wipe shown in FIGS. 3 and 4 is otherwise the same as the embodiment in FIGS. 1 and 2.

Figure 5:
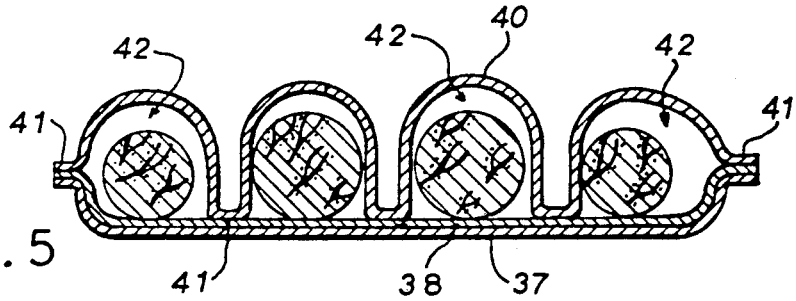
FIG. 5 is a sectional view similar to FIGS. 2 and 4 showing a modified version of the wipe having a multi-layer wiping surface.

For increased absorbency and strength, there is shown in FIG. 5 an embodiment in which the primary wiping layer 37 comprises a multi-layer laminate. In the specific embodiment shown, the primary wiping layer 37 includes two layers of which the inner layer 38 comprises a separate piece of absorbent paper generally contiguous in size and shape with the primary wiping layer 37. The overlying layer 40, which may be similar to the layer 16 of FIGS. 1–2 or layer 31 of FIGS. 3–4, is gathered in the same manner previously described and bound to double layers 37 and 38 with five generally parallel seams 41. The seams 41 may otherwise be formed in any of the manners previously described to define a series of finger-receiving pockets 42. If desired, the inner layer 38 could be made of a different paper than the primary layer 37 or even a non-paper sheet.

Figure 6:
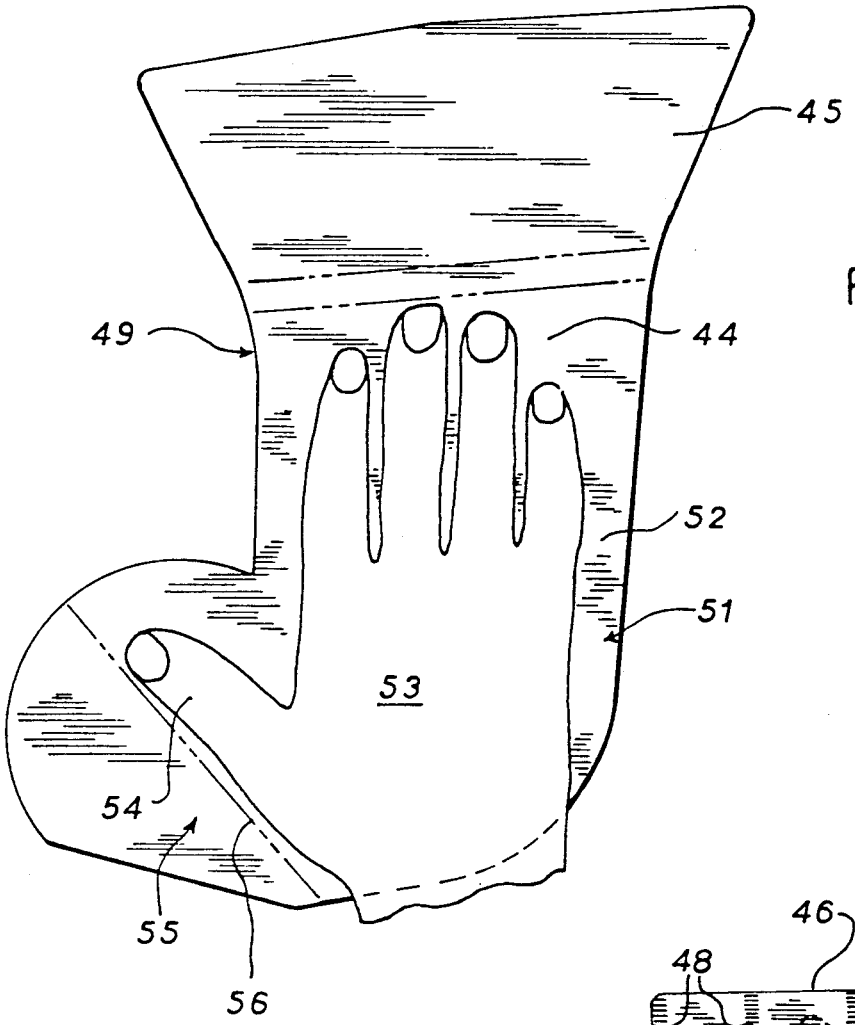
FIG. 6 is a top plan view of another embodiment of the present invention shown prior to folding and sealing to form finger and thumb-receiving pockets.
Figure 7:
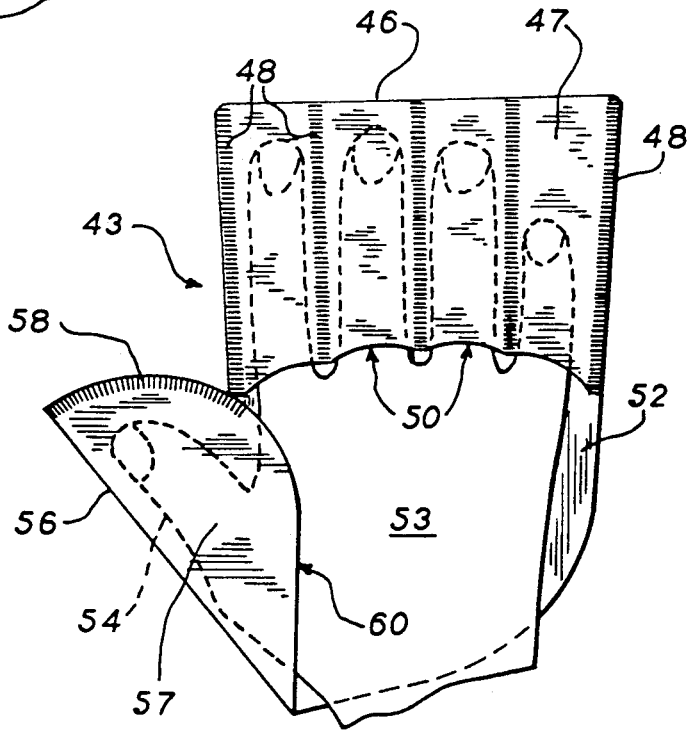
FIG. 7 is a top plan view of the wipe shown in FIG. 6 after the same has been folded and sealed to form seams which define the finger and thumb-receiving pockets.

In FIGS. 6 and 7, there is shown yet another embodiment of the invention in which the wipe comprises a substantially full hand-covering mitt 43. The single unitary sheet 44 used to form the mitt 43 includes a primary wiping layer 44 and an extended length portion 45 similar to those shown in the FIG. 1 embodiment. The extended length portion 45 fans laterally outwardly to provide an increased lateral width piece which is folded on a main fold line 46 to provide an overlying layer 47 substantially covering the primary wiping layer 44. The overlying layer 47 is gathered and attached to the primary layer 44 with five spaced seams 48 lying generally perpendicular to the main fold line 46 and forming with the bound layers four finger pockets 50. The construction show in FIGS. 3 and 4 could also be used to form the pockets and eliminate the outer seams, as previously described.

The unitary sheet 49 from which the mitt 43 is made also includes an integral longitudinal extension 51 of the primary wiping layer which extends from the edge opposite the main fold line 46. The longitudinal extension 51 defines a flat supplemental surface 52 which is large enough to cover the palm 53 and thumb 54 of the hand. The supplemental surface portion 52 includes an integral side piece 55 which is folded on an outer fold line 56 to form a thumb covering layer 57. This side piece 55 is generally in the shape of a sector of a circle and the outer fold line is positioned as a bisecting radius line of the circular sector. Thus, the thumb covering layer 57 of the side piece 55 overlies the remaining part of the side piece when folded. A side seam 58 binds the two parts of the side piece to form a thumb pocket 60. The side seam is generally formed along the common circular edge of the overlying parts of the side piece.

As with the previously described embodiments, the embodiment of FIG. 7 may be made of any type of absorbent paper sheet ranging from a low wet strength tissue material to a high wet strength paper towel material. The FIG. 7 mitt 43 provides a substantially enlarged wiping surface comprising the combined primary wiping layer 44 and the integral supplemental surface 52, together covering the entire hand. The wiping mitt is easily held in operative positions by pressing the fingers laterally together and released for disposal by opening the fingers, all in a manner previously described. The mitt 43 along with the other embodiments of the wipe 10 provide a simple and widely adaptable device for many wiping, cleaning and similar activities requiring or using an absorbent paper sheet. Each of the embodiments provides at least a flat primary wiping layer which is easily retained flat during use to eliminate bunching and wrinkling.

Various modes of carrying out the present invention are contemplated as being within the scope of the following claims particularly pointing out and distinctly claiming the subject matter which is regarded as the invention.

I claim:

1. A unitary hand-held wipe comprising:

a sheet of absorbent paper having a primary wiping layer defining a flat generally rectangular surface large enough to fully cover the fingers of a hand of average size;

said sheet including an extended length portion folded on a main fold line to form an overlying layer substantially covering the primary wiping layer; and, sealing means forming spaced seams binding the primary layer and the overlying layer, said seams extending generally perpendicular to the main fold line and defining between said seams finger-receiving pockets.

2. The invention as set forth in claim 1 wherein the extended length portion of said sheet has a width in the direction of said main fold line greater than the corresponding width of the primary wiping layer, thereby allowing said overlying layer to be gathered in said direction to form said finger-receiving pockets while maintaining said primary wiping layer flat.

3. The invention as set forth in claim 2 wherein said spaced seams include five seams defining therebetween four finger-receiving pockets.

4. The invention as set forth in claim 2 wherein the portions of the gathered overlying layer lying between adjacent pockets are adapted to be held tightly between adjacent fingers, whereby the primary wiping layer is held flat during use.

5. The invention as set forth in claim 1 including integral lateral width extensions on opposite edges of the primary wiping layer, each of said width extension folded on an auxiliary fold line to form a lateral layer overlying a portion of the primary wiping layer adjacent one opposite edge, and wherein said spaced seams comprise two outer seams binding said primary layer, overlying layer and a lateral layer to form outer finger-receiving pockets for the index and little fingers of the hand, and an inner seam between said outer seams and defining therewith pockets for the two middle fingers of the hand.

6. The invention as set forth in claim 1 wherein said sealing means comprises a water soluble adhesive.

7. The invention as set forth in claim 1 wherein said sealing means comprises a fiber-interlocking crimp.

8. The invention as set forth in claim 1 wherein said sealing means comprises stitched seams.

9. The invention as set forth in claim 1 wherein said primary wiping layer comprises a multi-layer laminate.

10. The invention as set forth in claim 1 including an integral longitudinal extension of said primary layer extending from the edge of said primary layer opposite said main fold line, said longitudinal extension defining a flat supplemental surface large enough to cover the palm and thumb of the hand.

11. The invention as set forth in claim 10 wherein said longitudinal extension includes an integral side piece folded on an outer fold line to form a thumb covering layer from one part of said side piece overlying the remaining part of said side piece, said sealing means forming a side seam binding said parts of the side piece to form a thumb-receiving pocket.

12. A hand-held wipe comprising:

a sheet of absorbent paper having a primary wiping layer defining a flat generally rectangular surface large enough to fully cover the fingers of a hand of average size;

an overlying layer substantially covering the primary wiping layer;

said overlying layer attached to the primary wiping layer along a leading edge; and, sealing means forming spaced seams binding the primary layer and the overlying layer, said seams extending generally perpendicular to the leading edge portion and defining between said seams finger-receiving pockets.

13. The invention as set forth in claim 12 wherein the overlying layer has a width in a direction generally parallel to said leading edge greater than the corresponding width of the primary wiping layer, thereby allowing said overlying layer to be gathered in said direction to form said finger-receiving pockets, whereby portions of the gathered overlying layer between adjacent pockets are adapted to be clamped tightly between the fingers of the user to hold the wipe from slipping off during use.

* * * * *